United States Patent [19]

Pruitt et al.

[11] Patent Number: 4,936,343

[45] Date of Patent: Jun. 26, 1990

[54] CARBON DIOXIDE FILL MANIFOLD

[76] Inventors: John E. Pruitt, PSR Box 80, Weatherford, Tex. 76086; John A. Pruitt, Rte. 1 Box 26, Perrin, Tex. 76075; Jay L. Pruitt, P.O. Box 36442, Ft. Worth, Tex. 76136

[21] Appl. No.: 328,614

[22] Filed: Mar. 27, 1989

[51] Int. Cl.[5] ..... F17C 7/04

[52] U.S. Cl. ..... 137/571; 62/50.2; 141/1

[58] Field of Search ..... 137/255, 571, 587; 222/3; 62/48.1, 50.2, 50.4, 384, 388; 141/1

[56] References Cited

U.S. PATENT DOCUMENTS

| | | | |
|---|---|---|---|
| 1,062,343 | 5/1913 | Mahoney | 137/587 X |
| 2,363,200 | 11/1944 | Pew et al. | 62/50.2 |
| 2,469,434 | 5/1949 | Hansen et al. | 62/50.2 |
| 2,479,070 | 8/1949 | Hansen | 62/50.2 |
| 3,093,974 | 6/1963 | Templer et al. | 62/50.2 |
| 3,392,537 | 7/1968 | Woerner | 62/50.2 |
| 3,712,073 | 1/1973 | Arenson | 62/50.2 |
| 3,990,256 | 11/1976 | May et al. | 62/50.2 |
| 4,321,796 | 3/1982 | Kohno | 62/50.2 |
| 4,683,921 | 8/1987 | Nesser | 141/1 |

*Primary Examiner*—John Rivell

*Attorney, Agent, or Firm*—John M. Harrison

[57] ABSTRACT

A carbon dioxide fill manifold which is designed to provide an end-user with an uninterrupted supply of carbon dioxide gas, while at the same time eliminating the necessity of transporting individual, conventional pressurized bottles to be refilled. The carbon dioxide fill manifold includes a fill line having a fill line valve therein for introducing liquid carbon dioxide into the system, one or more liquid chambers communicating with the fill line for receiving and storing liquid carbon dioxide, a liquid transfer line extending from the fill line to an atomizer, a service line connected to the atomizer and fitted with at least one vapor container for receiving gaseous carbon dioxide generated in the atomizer and a service line valve provided in the service line for servicing the end user with gaseous carbon dioxide. In an optional embodiment a bleeder valve line and bleeder valve are also connected to the atomizer, in order to determine when the system is filled with liquid and gaseous carbon dioxide and an in-line pressure relief valve, located in the liquid transfer line, serves to periodically replenish the supply of gaseous carbon dioxide to the vapor container(s) responsive to a selected pressure differential at the pressure relief valve.

24 Claims, 1 Drawing Sheet

CARBON DIOXIDE FILL MANIFOLD

Background of the Invention

1. Field of the Invention

This invention relates to gas transfer systems and more particularly, to a carbon dioxide fill manifold and method for handling liquid and gaseous carbon dioxide and dispensing the gaseous carbon dioxide to an end-user, such as a carbonated drink-dispensing system. The carbon dioxide fill manifold of this invention is characterized by a fill line provided with a fill line valve for introducing liquid carbon dioxide into the system, at least one liquid chamber communicating with the fill line for receiving and storing liquid carbon dioxide, an atomizer communicating with the fill line, a bleeder valve line communicating with the atomizer and provided with an optional bleeder valve for determining when the system is fully charged with liquid carbon dioxide and a service line also connected to the atomizer and provided with at least one vapor container for receiving and storing gaseous carbon dioxide generated in the system. A service line valve is provided in the service line, in order to facilitate dispensing of the gaseous carbon dioxide to an end-user. The carbon dioxide fill manifold and method of this invention are designed to store both liquid and gaseous carbon dioxide and to provide a substantially uninterrupted supply of gaseous carbon dioxide to an end-user such as a carbonated drink dispenser, without the necessity of transporting conventional carbon dioxide pressure vessels to and from the end-user site.

The carbon dioxide fill manifold of this invention is designed to provide a selected number of liquid chambers and corresponding vapor containers connected in series and separated by an atomizer, to allow for the appropriate ratio of gas to liquid in the system. After filling of the liquid chamber or chambers is complete according to the method of this invention, the customer or end-user will initially draw gas from the vapor container(s). When a predetermined volume of gaseous carbon dioxide has been used from these vapor container(s) by the customer to create a predetermined pressure differential between the vapor container(s) and the liquid chamber(s), an in-line pressure relief valve will automatically open to facilitate the flow of additional carbon dioxide into the atomizer. The atomizer allows this carbon dioxide to rapidly expand into a gas before entering the vapor container(s), in order to refill the vapor container(s). This gas-evolution process continues in the atomizer until the preselected pressure differential at the pressure relief valve has been equalized and the pressure relief valve then closes. A primary feature of the carbon dioxide fill manifold and method of this invention is the capacity for refilling both the liquid chamber(s) and the vapor container(s) without disconnecting these vessels from the supply and service lines, respectively. Since the liquid chamber(s) and vapor container(s) are filled by volume instead of by weight, the need to transport, handle and weigh the carbon dioxide-containing vessels is eliminated.

A common method of providing an end-user such as a carbonated drink dispensing apparatus with carbon dioxide gas, involves the use of high pressure bottles or cylinders which are manufactured in various sizes, typically 20 and 50 pound quantities, wherein the weight designation refers to the weight of the carbon dioxide in the bottles at full capacity. These bottles are typically filled by weight instead of volume, since a portion of each bottle (approximately 32%) must be reserved for expansion of the carbon dioxide into the vapor phase, in order to maintain an appropriate volume of liquid at a desired pressure. The problem of furnishing bottles of uniform weight and carbon dioxide volume is amplified by the fact that there is no uniform weight or tare among the bottles themselves. The bottles are typically filled by placing them on a scale and charging them with liquid carbon dioxide until the desired weight of liquid carbon dioxide is injected therein. Accordingly, the carbon dioxide supplier must periodically interrupt the customer supply, in order to exchange a full bottle for the empty bottle, using this system. The empty bottles must then be transported to a warehouse for weighing and refilling and the cycle is repeated. Expansion of a small amount of the carbon dioxide liquid into a gas exerts the necessary vapor pressure to maintain a proper gas-liquid balance in these bottles, to assure proper dispensing of carbon dioxide gas to the end-user. These conventional carbon-dioxide supply bottles are typically equipped with a rupture disc which is designed to rupture if the pressure inside the bottle rises beyond a specified level. Overfilling, that is, charging liquid carbon dioxide into that portion of the bottle which is normally reserved for gas expansion purposes, will cause this disc to burst, an occurrence which is both dangerous and wasteful.

1. Description of the Prior Art

Various types of liquid and gaseous vapor-containing and handling systems are well known to those in the art. A "Fluid Medium Storing and Dispensing System" is detailed in U.S. Pat. No. 2,412,613, dated Dec. 17, 1946, to H. C. Grant, Jr. The patent details one or more receptacles or containers for storing a high-pressure fluid medium such as liquified carbon dioxide. Further included is a fluid medium retaining and releasing apparatus associated with each of the containers, which apparatus is adapted to be operated by the fluid medium from one or more containers in the system. A suitable actuating device which is operable by a relatively small force for initiating simultaneous release of the fluid medium from one or more of the containers, is also provided. U.S. Pat. No. 2,492,165, dated Dec. 27, 1949, to D. Mapes, details a "System for Dispensing Fluids". The system includes multiple receptacles containing a fluid under pressure, apparatus provided in each of the receptacles for normally retaining a fluid therein, which apparatus operates to release the fluid from the receptacles, delivery means into which the fluid may be delivered from all the receptacles and a fluid-actuated operating device for operating the retaining apparatus of each receptacle. Apparatus for conducting fluid from the delivery means to the operating apparatus with at least one of the receptacles is also provided. A "Pneumatic Installation" is detailed in U.S. Pat. No. 2,591,641, dated Apr. 1, 1952, to J. Troendle. The installation includes one or more sources of compressed air, one or more devices to be fed with compressed air for pneumatic control purposes, several compressed air reservoirs, and conduits connecting the various elements to each other. U.S. Pat. No. 3,760,834, dated Sept. 25, 1973, to David E. Shonerd, et al, details a "Reservoir for Pressurized Fluids". The reservoir includes multiple, straight tubes located in side-by-side relationship and surrounded by a single, elongated tube of substantially less diameter which is helically wound about the straight tubes to define a reservoir for pressurized natural gas. The helically-wound tube serves both as a protective covering and a strengthening structure for the straight tubes. The straight tubes and helically-wound tubes may be interconnected by suitable manifolding and a fill opening is provided for storing pressurized fluid therein.

It is an object of this invention to provide a carbon dioxide fill manifold which is designed to provide an end-user with a substantially uninterrupted supply of carbon dioxide gas, while at the same time eliminating the necessity of transporting individual conventional bottles or cylinders for refilling purposes.

Another object of the invention is to provide a carbon dioxide fill manifold and method for dispensing gaseous carbon dioxide to an end user from a liquid carbon dioxide charge, wherein the quantity of the gas distributed is determined by volume, rather than by weight.

Yet another object of this invention is to provide a new and improved carbon dioxide fill manifold which is designed for on-site use to facilitate connection of multiple liquid chamber bottles and companion vapor chamber bottles using an atomizer, wherein an end-user or customer is supplied with a substantially uninterrupted source of carbon dioxide gas at a desired pressure.

Yet another object of the invention is to provide a carbon dioxide fill manifold which utilizes an atomizer and an in-line pressure relief valve according to the method of this invention to periodically vaporize a charge of carbon dioxide for dispensing in the gaseous phase to an end-user.

Still another object of this invention is to provide a carbon dioxide fill manifold which is characterized by a series of fittings and valves constructed from high pressure material and designed to incorporate a selected number of liquid chambers and vapor containers, wherein the total volume of the vapor containers represents approximately 32% or more of the total volume of the liquid chambers and vapor containers and the liquid chambers and vapor containers are separated by an atomizer, the manifold is initially charged with liquid carbon dioxide to fill the liquid chambers, and the liquid carbon dioxide is converted to gaseous carbon dioxide for dispensing to a customer.

Still another object of this invention is to provide a new and improved carbon dioxide fill manifold and method for storing liquid and gaseous carbon dioxide which facilitate the dispensing of carbon dioxide gas to a customer or end-user on a volume, rather than a weight basis and thereby eliminates the necessity of using multiple, conventional individual carbon dioxide bottles or cylinders which must be periodically returned to a plant and refilled.

SUMMARY OF THE INVENTION

These and other objects of the invention are provided in a new and improved carbon dioxide fill manifold which is characterized in a preferred embodiment by a fill line provided with a fill line valve for receiving a charge of liquid carbon dioxide; a selected number of liquid chambers provided in communication with the fill line for receiving and storing the carbon dioxide; a liquid transfer line connecting the fill line to an in-line pressure relief valve and an atomizer; an optional bleeder valve line extending from the vaporizer and a bleeder valve provided in the bleeder valve line for determining when the system is fully charged with liquid carbon dioxide; and a service line connected to the atomizer, with a selected number of vapor containers communicating with the service line. A method for receiving and storing gaseous carbon dioxide and distributing the gaseous carbon dioxide to an end-user responsive to the flow of liquid carbon dioxide from the liquid chambers through the in-line pressure relief valve to the atomizer at a selected pressure differential using the carbon dioxide fill manifold.

BRIEF DESCRIPTION OF THE DRAWING

The invention will be better understood by reference to the accompanying drawing, wherein.

DESCRIPTION OF THE PREFERRED EMBODIMENTS

Figure 1:
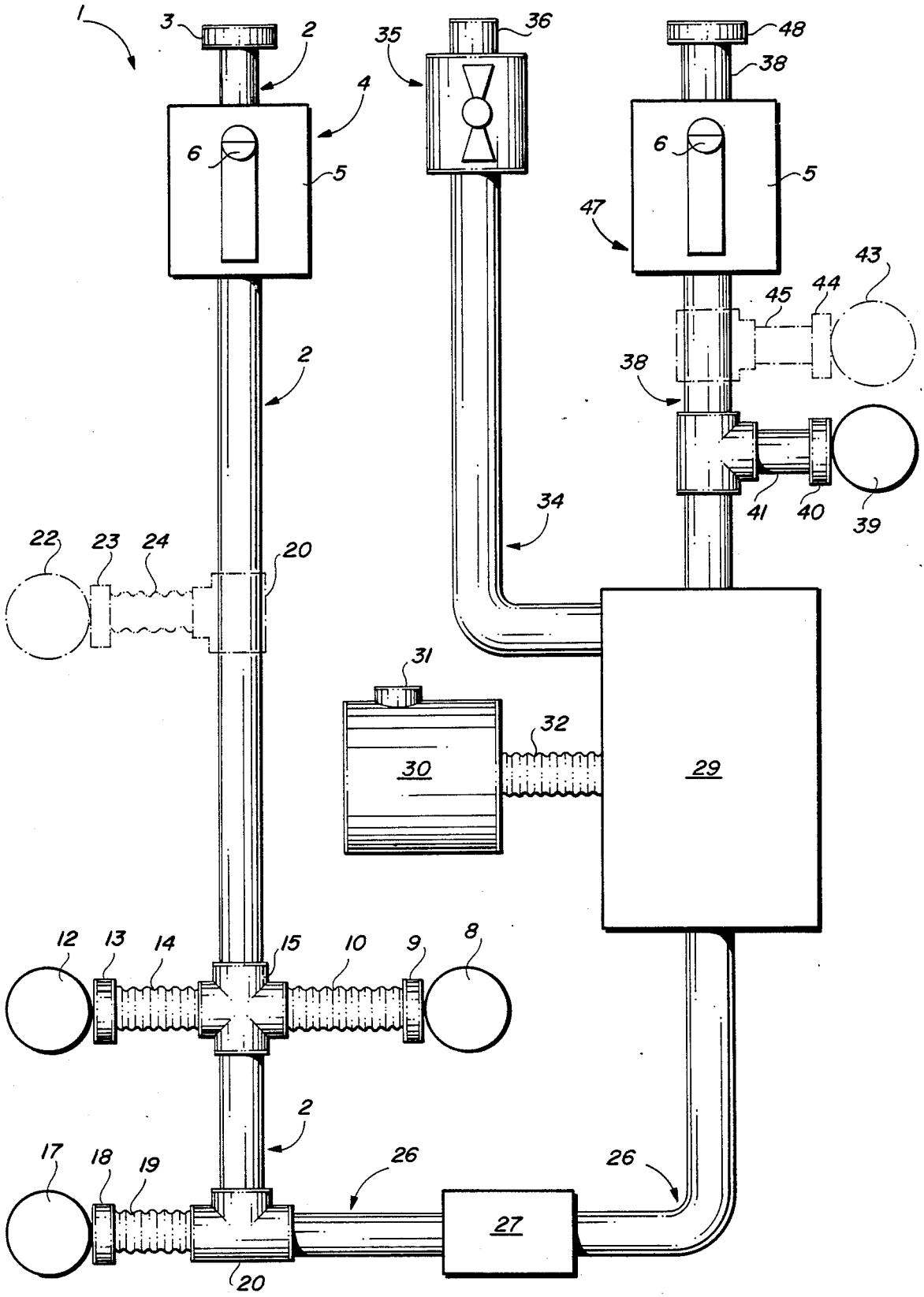
FIG. 1 represents a schematic diagram of a preferred embodiment of the carbon dioxide fill manifold and method of this invention.

Referring now to FIG. 1 of the drawing, the carbon dioxide fill manifold of this invention is generally illustrated by reference numeral 1. The carbon dioxide fill manifold 1 is characterized in a preferred embodiment by a fill line 2, fitted with a fill line flange 3 therein for receiving a cooperating coupling (not illustrated) of a vessel such as a truck (not illustrated), containing liquid carbon dioxide, and injecting the liquid carbon dioxide into the fill line 2. A fill line valve 4 is provided in the fill line 2 near the fill line flange 3 and the fill line valve 4 is characterized by a valve body 5 and a valve plug 6, for opening and closing the fill line valve 4, as desired. It will be appreciated by those skilled in the art that the fill line valve 4 may be of any suitable design which is operable to handle liquid carbon dioxide, according to the knowledge of those skilled in the art and the schematic design of the fill line valve illustrated in FIG. 1 is provided for purpose of illustration only. A four-way chamber fitting 15 is provided in the fill line 2 downstream from the fill line valve 4 and a first chamber flexible connection 10 extends from one leg of the four-way chamber fitting 15, as illustrated. A first chamber flange 9 terminates the opposite end of the first chamber flexible connection 10 and a first liquid chamber 8 is connected to the first chamber flange 9 in liquid-receiving relationship. A second chamber flexible connection 14 extends from the opposite leg of the four-way chamber fitting 15 and a second chamber flange 13 is connected to the extending end of the second chamber flexible connection 14. A second liquid chamber 12 is connected to the second chamber flange 13, as further illustrated in FIG. 1. Similarly, a T-chamber fitting 20 is provided in the fill line 2, a third chamber flexible connection 19 extends from one leg of the T-chamber fitting 20 and a third chamber flange 18 is attached to the extending end of the third chamber flexible connection 19. Furthermore, a third liquid chamber 17 is connected to the third chamber flange 18 and the opposite leg of the T-chamber fitting 20 is connected to a liquid transfer line 26. Accordingly, it will be appreciated by those skilled in the art that liquid carbon dioxide which is charged into the fill line 2 through the fill line flange 3 and the fill line valve 4 is allowed to fill the first liquid chamber 8, the second liquid chamber 12 and the third liquid chamber 17, which communicate with the fill line 2, as heretofore described. Furthermore, one or more additional T-chamber fittings 20, one of which is illustrated in phantom upstream from the 4-way chamber fitting 15, can be provided in the fill line 2, along with a future chamber flexible connection 24, a future chamber flange 23 and a future liquid chamber 22, as further illustrated in phantom.

An in-line pressure relief valve 27 is provided in the liquid transfer line 26 and the liquid transfer line 26 communicates with an atomizer 29, as further illustrated in FIG. 1. An atomizer pressure relief valve 30 also communicates with the atomizer 29 through an atomizer flexible connection 32 and a vent 31 is provided on the vaporizer pressure relief valve 30 for discharging carbon dioxide from the atomizer pressure relief valve 30, if the system pressure rises above a predetermined level. One end of an optional bleeder valve line 34 is also attached to the atomizer 29 and the opposite end receives a bleeder valve 35 and a bleeder valve nozzle 36, for purposes which will be hereinafter further described. One end of a service line 38 extends from the atomizer 29 and a first container nipple 41 communicates with the service line 38, as illustrated. A first container flange 40 terminates the extending end of the first container nipple 41 and a first vapor container 39 is secured to the first container flange 40, in order to facilitate filling the first vapor container 39 with carbon dioxide vapor, as hereinafter further described. One or more future container nipples 45, one of which is illustrated in phantom, may also be provided in communication with the service line 38, along with a future container flange 44 and a future vapor container 43, also illustrated in phantom. As in the case of the first vapor container 39, the future vapor container 43 is designed to receive and store gaseous carbon dioxide, as further hereinafter described. A service line valve 47, having a valve plug 6, is provided in the service line 38 downstream from the first vapor container 39 and a service line flange 48 terminates the extending end of the service line 38, in order to supply an end-user with gaseous carbon dioxide.

In operation, and referring again to FIG. 1, the carbon dioxide fill manifold 1 is designed for installation on site at a customer or end-user location. The carbon dioxide fill manifold 1 may be pre-filled or the fill line 2 may be connected to a source of liquid carbon dioxide such as a tank truck or alternative vessel (not illustrated), by connecting the fill line flange 3 with a suitable matching connecting mechanism (not illustrated) provided on the tank truck. The number of liquid chambers and vapor containers in the carbon dioxide fill manifold 1 is then checked to ascertain that the ratio of the liquid chamber volume to the vapor container volume is approximately 68%, in order to allow for a proper carbon dioxide vapor space in the system. In a preferred embodiment of the invention, a first liquid chamber 8, second liquid chamber 12 and third liquid chamber 17 are provided in communication with the fill line 2, as illustrated. Furthermore, a single first vapor container 39 is provided in communication with the service line 38 and in the carbon dioxide fill manifold 1, in order to satisfy these requirements. However, it is understood that any number of bottles or chambers may be used, so long as approximately 32% of the total chamber volume is reserved for vapor expansion. Accordingly, it will be appreciated by those skilled in the art that one or more future liquid chambers 22 and future vapor containers 43 may also be provided in the carbon dioxide fill manifold 1 as illustrated in phantom, so long as the overall liquid chamber to gas chamber ratio of about 3 to 1, or a gas volume space of at least 32% of the entire liquid chamber and vapor container volume, is maintained in the system. For example, two liquid chambers designed to contain 100 pounds of carbon dioxide each, can be used in conjunction with one gas or vapor container designed to hold 100 pounds of carbon dioxide, in order to maintain the proper liquid carbon dioxide-to- gaseous carbon dioxide ratio in the carbon dioxide fill manifold 1.

According to the method of this invention, as liquid carbon dioxide is charged into the fill line 2, it flows through the four-way chamber fitting 15, the first chamber flexible connection 10 and first chamber flange 9, into the first liquid chamber 8. Carbon dioxide also flows through the second chamber flexible connection 14, second chamber flange 13 and into the second liquid chamber 12 and through the T-chamber fitting 20, the third chamber flexible connection 19, the third chamber flange 18 and into the third liquid chamber 17. The carbon dioxide continues to flow through the fill line 2 until it fills the first liquid chamber 8, second liquid chamber 12 and third liquid chamber 17, as well as the fill line 2, the liquid transfer line 26, the in-line pressure relief valve 27 and a portion of the atomizer 29, after which it flows through the optional bleeder valve line 34 and into the bleeder valve 35. A small quantity of carbon dioxide also flows into the service line 38 and through the first container nipple 41, the first container flange 40 and into the first vapor container 39. The flow of liquid carbon dioxide into the fill line 2 through the fill line flange 3 and the fill line valve 4 is continued until liquid carbon dioxide is noted at the optional open bleeder valve 35. At this time the bleeder valve 35 is closed, along with the fill line valve 4 and the source of liquid carbon dioxide is disconnected from the fill line flange 3. The system is now ready for use by the customer and the customer's carbonated drink dispenser or other end-user apparatus (not illustrated) is connected to the service line flange 48. Gaseous carbon dioxide is periodically dispensed from the atomizer 29 into the service line 38 and the first vapor container 39, such that operation of the service line valve 47 facilitates a flow of gaseous carbon dioxide into the end-user apparatus on demand. When a sufficient volume of carbon dioxide gas has been dispensed to the end-user to create a predetermined pressure differential between the first liquid chamber 8, second liquid chamber 12 and third liquid chamber 17 and the first vapor container 39 at the in-line pressure relief valve 27, then the in-line pressure relief valve 27 automatically opens to facilitate a flow of additional liquid carbon dioxide from the first liquid chamber 8, second liquid chamber 12 and the third liquid chamber 17, through the liquid transfer line 26 and into the atomizer 29. The atomizer 29 then atomizes an additional quantity of carbon dioxide to resupply the service line 38 and the first vapor container 39 with gaseous carbon dioxide for additional use by the end-user.

It will be appreciated by those skilled in the art that the equipment used in the carbon dioxide fill manifold 1 of this invention must be chosen to withstand a pressure of up to about 1500 psig for all-season use. For example, the fill line 2 and liquid transfer line 26 should be constructed of such material as schedule 80 steel tubing and the 4-way chamber fitting 15 and tee chamber fitting 20, as well as other fittings, should be constructed of stainless steel or other suitable material. A positive displacement liquid carbon dioxide pump {not illustrated) may be mounted on a tank truck or other liquid carbon dioxide supply vessel (not illustrated) and used to supply liquid carbon dioxide to the fill line 2 at a pressure of about 1300 psig.

While the in-line pressure relief valve 27 may be adjusted or chosen to operate at any selected pressure drop between the first liquid chamber 8, second liquid chamber 12 and the third liquid chamber 17 and the first vapor container 39, a pressure drop of about 100 pounds across the in-line pressure relief valve 27 is preferred, in order to activate the flow of liquid carbon dioxide into the atomizer 29.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A carbon dioxide fill manifold for storing liquid and gaseous carbon dioxide and dispensing gaseous carbon dioxide, comprising at least one liquid chamber having a selected chamber volume for containing liquid carbon dioxide under pressure; pressure relief valve means communicating with said liquid chamber; atomizer means communicating with said pressure relief valve means for receiving carbon dioxide and vaporizing at least a portion of the carbon dioxide responsive to a selected difference in pressure between said liquid chamber and said atomizer means; and at least one vapor container communicating with said atomizer means, said vapor container having a selected container volume and adapted to contain gaseous carbon dioxide under pressure and dispense the gaseous carbon dioxide to a user.

2. The carbon dioxide fill manifold of claim 1 wherein said chamber volume is about three times as large as said container volume.

3. The carbon dioxide fill manifold of claim 1 wherein said container volume further comprises at least 32 percent of the total of said chamber volume and said container volume.

4. The carbon dioxide fill manifold of claim 1 further comprising a fill line communicating with said liquid chamber; fill line valve means provided in said fill line upstream from said liquid chamber for controlling the flow of liquid carbon dioxide through said fill line into said liquid chamber; a liquid transfer line communicating with said liquid chamber and said pressure relief valve means means for introducing the carbon dioxide into said pressure relief valve means and said-atomizer means; and a service line communicating with said atomizer means and said vapor container, for introducing the gaseous carbon dioxide into said vapor container.

5. The carbon dioxide fill manifold of claim 4 wherein said chamber volume is about three times as large as said container volume.

6. The carbon dioxide fill manifold of claim 4 wherein said container volume further comprises at least 32 percent of the total of said chamber volume and said container volume.

7. The carbon dioxide fill manifold of claim 4 further comprising service line valve means provided in said service line downstream of said vapor container for selectively delivering gaseous carbon dioxide to the user.

8. The carbon dioxide fill manifold of claim 4 further comprising a bleeder valve line communicating with said atomizer means and bleeder valve means provided in said bleeder valve line for indicating when the liquid carbon dioxide is flowing into said atomizer means.

9. The carbon dioxide fill manifold of claim 8 further comprising service line valve means provided in said service line downstream of said vapor container for selectively delivering gaseous carbon dioxide to the user.

10. The carbon dioxide fill manifold of claim 13 wherein said chamber volume is about three times as large as said container volume.

11. The carbon dioxide fill manifold of claim 9 wherein said container volume further comprises at least 27 percent of the total of said chamber volume and said container volume.

12. The carbon dioxide fill manifold of claim 11 wherein said atomizer means further comprises a carbon dioxide atomizer and an atomizer pressure relief valve communicating with said atomizer.

13. A carbon dioxide fill manifold for storing liquid and gaseous carbon dioxide and dispensing gaseous carbon dioxide to an end user, comprising a plurality of liquid chambers having a selected collective chamber volume for containing liquid carbon dioxide under pressure; an atomizer provided in fluid communication with said liquid chambers for receiving liquid carbon dioxide and vaporizing at least a portion of the liquid carbon dioxide into gaseous carbon dioxide; an in-line pressure relief valve provided in fluid communication with said liquid chambers and said atomizer, for supplying liquid carbon dioxide from said liquid chambers to said atomizer responsive to a selected difference in pressure between said liquid chambers and said atomizer; and at least one vapor container communicating with said atomizer, said vapor container having a selected container volume which is about 32 percent as large as said chamber volume and said container volume combined, said vapor container further adapted to contain gaseous carbon dioxide under pressure and dispense the gaseous carbon dioxide to a user.

14. The carbon dioxide fill manifold of claim 13 further comprising a fill line communicating with said liquid chambers; a fill line valve provided in said fill line upstream from said liquid chambers for controlling the flow of liquid carbon dioxide through said fill line into said liquid chambers; a liquid transfer line communicating with said liquid chambers and said atomizer for introducing the liquid carbon dioxide into said atomizer; a service line communicating with said atomizer and said vapor container, for introducing the gaseous carbon dioxide into said vapor container; and a bleeder valve line communicating with said atomizer and a bleeder valve provided in said bleeder valve line for indicating when the liquid carbon dioxide is flowing into said atomizer.

15. A carbon dioxide fill manifold for storing liquid and gaseous carbon dioxide and dispensing gaseous carbon dioxide to an end user, comprising a plurality of liquid chambers having a selected collective chamber volume for containing liquid carbon dioxide under pressure; an atomizer provided in fluid communication with said liquid chambers for receiving carbon dioxide and vaporizing at least a portion of the carbon dioxide into gaseous carbon dioxide; an in-line pressure relief valve provided in fluid communication with said liquid chambers and said atomizer, for supplying liquid carbon dioxide from said liquid chambers to said atomizer responsive to a selected difference in pressure between said liquid chambers and said atomizer; and a plurality of vapor containers communicating with said atomizer, said vapor containers having a selected collective container volume which is at least about 32 percent as large as said chamber volume and said container volume combined, said vapor containers further adapted to contain gaseous carbon dioxide under pressure and dispense the gaseous carbon dioxide to a user.

16. The carbon dioxide fill manifold of claim 15 further comprising a fill line communicating with said liquid chambers; a fill line valve provided in said fill line upstream from said liquid chambers for controlling the flow of liquid carbon dioxide through said fill line into said liquid chambers; a liquid transfer line communicating with said liquid chambers and said atomizer for introducing the carbon dioxide into said atomizer; a service line communicating with said atomizer and said vapor container, for introducing the gaseous carbon dioxide into said vapor container; and a bleeder valve line communicating with said atomizer and a bleeder valve provided in said bleeder valve line for indicating when the liquid carbon dioxide is flowing into said atomizer.

17. A method for storing liquid and gaseous carbon dioxide and selectively dispensing gaseous carbon dioxide, comprising the steps of:

(a) providing a carbon dioxide fill manifold having at least one liquid chamber for containing a liquid carbon dioxide, at least one vapor container for containing gaseous carbon dioxide and atomizer means located between said liquid chamber and said vapor container;

(b) providing an in-line pressure relief valve in said manifold, wherein said in-line pressure relief valve is connected to said liquid chamber and said atomizer means for regulating the flow of liquid carbon dioxide from said liquid chamber to said atomizer means responsive to the pressure differential between said liquid chamber and said atomizer means;

(c) introducing liquid carbon dioxide into said liquid chamber and allowing said liquid carbon dioxide to flow through said in-line pressure relief valve into said atomizer means responsive to said pressure differential, whereby at least a portion of said liquid carbon dioxide vaporizes in said atomizer means into gaseous carbon dioxide and flows into said vapor container for dispensing to a customer.

18. The method as recited in claim 17 comprising the additional step of providing bleeder valve means in said manifold in fluid communication with said atomizer means for receiving a quantity of liquid carbon dioxide and indicating when said liquid chamber is full of said liquid carbon dioxide.

19. The method as recited in claim 17 comprising the additional step of providing a fill line valve in said manifold in fluid communication with said liquid chamber for controlling the flow of liquid carbon dioxide to said liquid chamber.

20. The method as recited in claim 17 comprising the additional steps of:

(a) providing bleeder valve means in said manifold in fluid communication with said atomizer means for receiving a quantity of liquid carbon dioxide and indicating when said liquid chamber is full of said liquid carbon dioxide; and (b) providing a fill line valve in said manifold in fluid communication with said liquid chamber for controlling the flow of liquid carbon dioxide to said liquid chamber.

21. The method as recited in claim 17 comprising the additional step of providing a service line valve in said manifold in fluid communication with said vapor container for controlling the flow of gaseous carbon dioxide from said vapor container to the customer.

22. The method as recited in claim 21 comprising the additional steps of:

(a) providing bleeder valve means in said manifold in fluid communication with said atomizer means for receiving a quantity of liquid carbon dioxide and indicating when said liquid chamber is full of said liquid carbon dioxide; and (b) providing a fill line valve in said manifold in fluid communication with said liquid chamber for controlling the flow of liquid carbon dioxide to said liquid chamber.

23. The method as recited in claim 17 comprising the additional steps of:

(a) providing bleeder valve means in said manifold in fluid communication with said atomizer means for receiving a quantity of liquid carbon dioxide and indicating when said liquid chamber is full of said liquid carbon dioxide;

(b) providing a fill line valve in said manifold in fluid communication with said liquid chamber for controlling the flow of liquid carbon dioxide to said liquid chamber; and (c) providing a service line valve in said manifold in fluid communication with said vapor container for controlling the flow of gaseous carbon dioxide from said vapor container to the customer.

24. A method for storing liquid and gaseous carbon dioxide and selectively dispensing gaseous carbon dioxide, comprising the steps of:

(a) providing a carbon dioxide fill manifold having a plurality of liquid chambers characterized by a first selected volume for containing liquid carbon dioxide, at least one vapor container having a second selected volume, wherein said second selected volume is at least about 32% of the total of said first selected volume and said second selected volume, for containing gaseous carbon dioxide and atomizer means disposed between said liquid chamber and said vapor container;

(b) providing a fill line valve in said manifold in fluid communication with said liquid chambers for controlling the flow of liquid carbon dioxide to said liquid chambers;

(c) providing bleeder valve means in said manifold in fluid communication with said atomizer means for receiving a quantity of liquid carbon dioxide and indicating when said liquid chambers are full of said liquid carbon dioxide;

(d) providing a service line valve in said manifold in fluid communication with said vapor container for controlling the flow of gaseous carbon dioxide from said vapor container to the customer;

(e) providing an in-line pressure relief valve in said manifold connected to said liquid chambers and said atomizer means for regulating the flow of liquid carbon dioxide from said liquid chambers to said atomizer means responsive to the pressure differential between said liquid chambers and said atomizer means; and (f) introducing liquid carbon dioxide into said liquid chambers through said fill line valve and allowing said liquid carbon dioxide to flow through said in-line pressure relief valve into said atomizer means and said bleeder valve means responsive to said pressure differential, whereby at least a portion of said liquid carbon dioxide vaporizes in said atomizer means into gaseous carbon dioxide and flows into said vapor container for dispensing through said service line valve to a customer.

* * * * *